US005601285A

United States Patent [19]

Baxter, III

[11] Patent Number: 5,601,285

[45] Date of Patent: Feb. 11, 1997

[54] BASEBALL CATCHING TRAINING DEVICE

[76] Inventor: Malcolm M. Baxter, III, 581 Buena Pkwy., Bridgewater Township, Somerset County, N.J. 08807

[21] Appl. No.: 573,668

[22] Filed: Dec. 18, 1995

[51] Int. Cl.[6] ..... A63B 69/00

[52] U.S. Cl. ..... 473/458

[58] Field of Search ..... 273/25, 26 R, 273/26 C, 29 A; 70/16, 17

[56] References Cited

U.S. PATENT DOCUMENTS

| | | | |
|---|---|---|---|
| 3,858,881 | 1/1975 | Hurwitz | 273/29 A |
| 4,239,228 | 12/1980 | Norman et al. | 273/189 R |
| 4,637,610 | 1/1987 | Carr | 273/26 C |
| 5,005,833 | 4/1991 | Groveman et al. | 273/29 A |
| 5,031,238 | 7/1991 | Hayes | 2/19 |
| 5,145,179 | 9/1992 | Breed | 273/189 R |

*Primary Examiner*—William H. Grieb
*Attorney, Agent, or Firm*—Kenneth P. Glynn, Esquire

[57] ABSTRACT

The present invention involves a baseball catching training device. It includes a first yoke for removable attachment to a first wrist of a user and a second yoke for removable attachment to a second wrist of the user. The first yoke and the second yoke are made of flexible material, are elongated and have a middle portion and each have two opposing ends, the opposing ends having complementary attachment mechanisms for removably attaching one opposing end to an opposite opposing end. It also includes a connecting strap having a first and a second end, the first end being connected to the middle portion of the first yoke and the second end being connected to the middle portion of the second yoke. The connecting strap is flexible, stretchable and elongated and has a length no greater than 18 inches. In other preferred embodiments, the attachment mechanisms are filamentary loop and hook mechanisms.

19 Claims, 2 Drawing Sheets

BASEBALL CATCHING TRAINING DEVICE

BACKGROUND OF THE INVENTION

1. Field of the Invention

The present invention is directed to a baseball catching training device which forces a player to follow a gloved hand with the other hand to thereby use both hands to catch. It involves two yolks for the wrist and a flexible connecting strap.

2. Information Disclosure Statement

The following patents are examples of sports training devices on U.S. Pat. No. 4,239,228 issued to Norman et al. describes an adjustable tether for joining the upper arms of a golfer together to coordinate the relative motion of the arms of the golfer during his swing. The arm joining tether comprises first and second generally Y-shaped flexible straps each having a stem portion which is bifurcated so as to terminate in branch portions which may be joined by suitable fasteners to form arm engaging loops. The stem portions may also be joined by a suitable two-element separable fastener and when in use, the joined stem portions span the chest of the user. It has been found that mating hook and loop type fasteners are ideally suited for joining the Y-shaped flexible strap members, one to the other, and in coupling the branch portions of each to form the aforesaid arm engaging loops. Further, each of the individual Y-shaped strap members is marked with a suitable graduated marking to facilitate the sizing of the device to golfers of different physical size.

U.S. Pat. No. 4,637,610 issued to Carr describes how there is disclosed a holder for a baseball glove, particularly a fielder's glove and a training aid. The holder comprises a body with a scoop formed of a stiff, shape-retaining sheet material having a rear face with a convex contour conforming to the ball pocket of a fielder's glove. The glove is received over the rear face of the scoop and is retained in this assembly by a cover which fits over the rear of the glove. Preferably, the cover is webbing which overlies the rear of the fingers of the glove and the sheet material is a resilient plastic thereby permitting the glove former to be used as a training aid which requires the player to use both hands when fielding a ball.

U.S. Pat. No. 5,005,833 issued to Groveman et al. describes a wrist band that is provided for each of the user's wrists, such wrist bands being removably attachable to the wrists by wrapping therearound and securing in place by a fastening device such as a velcro fastener. Each band has a looped thong extended therefrom in the direction of the user's fingers, the user's middle finger fitting through the thong such that palmar flexion of the hand is restricted. The wrist bands are joined together by a strap which is attached to the bands in the region of the user's thumbs. The user's wrists are thus joined together so that in preparing for and in making a tennis stroke, the arms move together so as to facilitate the training of a player to turn the shoulders and twist the body. A single one of the wrist bands can also be used on the hand used for making the toss in serving to train the player to toss the ball straight up or on the racquet holding hand to train the player to avoid palmar flexion while driving the ball.

U.S. Pat. No. 5,031,238 issued to Hayes describes a support portion for a baseball glove which may be integrally formed with the glove or separately attached thereto, the support portion being attached to a back wall of the glove so as to extend a distance above and below the free lower edge of the front wall of the glove sufficient to cover a lower back portion of the user's hand, the back of the user's wrist, and a back portion of the user's forearm. The support portion includes a securing member adapted to wrap around a user's arm below the wrist. In use, the support portion serves the dual purposes of supporting the user's wrist against injurious bending and imparting a natural control and feel to the glove. The support portion may include indentations on each side to provide a greater lateral and forward hand and wrist flexibility while still providing support for the backward motion of the hand and wrist. The strap portion may include an elastic member to provide a better fit on various sized user's wrists.

U.S. Pat. No. 5,145,179 issued to Breed describes a golf putting training device includes a laterally adjustable spacing member, a pair of pivotally adjustable forearm bracing members attached on opposing ends thereof, and an adjustable strap on one of the bracing members for securing the training device to the user's forearm. The training device is adjustable to the varying spacial and angular alignments of the user's forearms and can be adjusted to accommodate a plurality of different user's forearms for use during the putting stroke. The adjustable training device correctly positions the forearms in spaced relation, and effectively stabilizes them, thus preventing relative motion with respect to one another during the putting stroke.

Notwithstanding the above prior art, it is believed that the device and method set forth herein is neither taught nor rendered obvious.

SUMMARY OF THE INVENTION

The present invention involves a baseball catching training device for enhancing or encouraging two handed catches. This reduces "drops", increases outs, and speed up return throws to the infield. The device includes a first yoke for removable attachment to a first yoke, and a second yoke for removable attachment to second wrist of the user. The first yoke and the second yoke are made of flexible material, are elongated and have a middle portion and each have two opposing ends, the opposing ends having complementary attachment mechanisms for removably attaching one opposing end to an opposite opposing end. It also includes a connecting strap having a first and a second end, the first end being connected to the middle portion of the first yoke and the second end being connected to the middle portion of the second yoke. The connecting strap is flexible, stretchable and elongated and has a length no greater than 18 inches. In other preferred embodiments, the attachment mechanisms are filamentary loop and hook mechanisms.

BRIEF DESCRIPTION OF THE DRAWINGS

The present invention will be more fully understood when the specification herein is taken in conjunction with the drawings appended hereto, wherein.

DETAILED DESCRIPTION OF THE PRESENT INVENTION

As stated in the Summary above, the present invention is a baseball catching training device which disciplines and accustoms the user, by automatically moving the non-catching arm in concert with the gloved arm, to use two hands when attempting to catch a baseball. The end result is that the user makes fewer errors and quicker throws. The baseball catching training device is a lightweight, simple to use mechanism. Due to its size and weight, it is easily transportable and can be used anywhere. The baseball catching training device consists of two wrist enclosing yokes, and a connecting strap for the two yokes. In addition, the baseball catching training device has an optional connecting piece, which attaches the glove of the user to the baseball catching training device.

Figure 1:
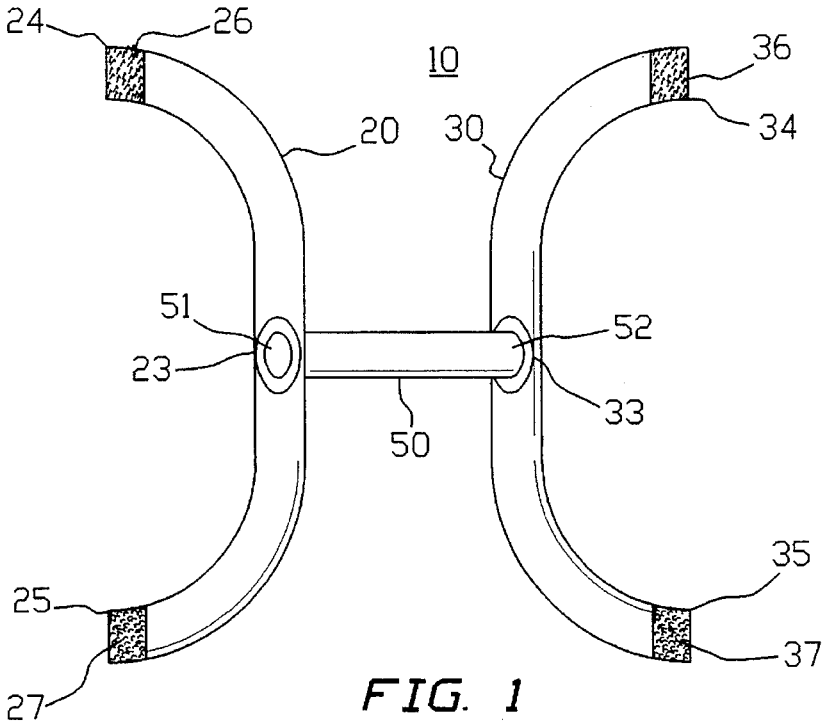
FIG. 1 shows a perspective view of a present invention device in an open position.
Figure 2:
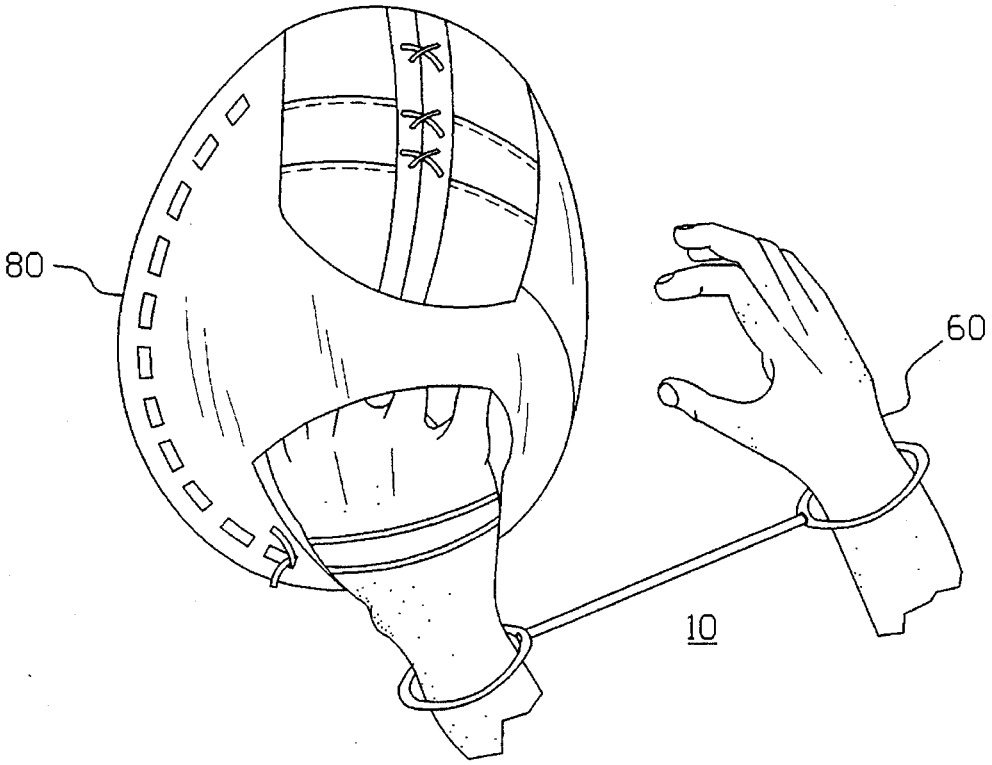
FIG. 2 shows the present invention device connected to the wrist of a baseball player; and, FIG. 3 shows an alternate embodiment of the present invention device with means of attachment to a baseball glove.

Referring to FIG. 1, the present invention involves a baseball catching training device 10 which fosters or encourages the use of both hands when attempting to catch a baseball. Referring also to FIG. 2, a preferred embodiment of the baseball catching training device 10 is illustrated as it would appear on a user. The baseball catching training device 10 includes a pair of yokes 20 and 30, which are designed for attachment to a pair of wrists 60. Yokes 20 and 30 are preferably made from an elongated, flexible material. This piece could be constructed from, but is not limited to, flexible plastics, rubber based materials, injection molded plastics, and other such flexible materials. In alternative embodiments, yokes 20 and 30 can be made from, for example, inflexible materials, such as hard rubber and/or reinforced plastics. Yokes 20 and 30 have a middle section 23 and 33, and a pair of opposing ends 24, 25 and 34, 35, respectively. Affixed to each pair of opposing ends 24, 25 and 34, 35 are complementary attachment mechanisms 26, 27 and 36, 37, which permit one end of the pair of opposing ends 24, 25 and 34, 35 to be removably attached to the remaining end, respectively. This allows for easy attachment and removal of the baseball catching device 10 from the wrists 60 of a user. In the preferred embodiment, the complementary attachment mechanisms 26, 27 and 36, 37 are looped and hooked filament attachment mechanisms. In general, however, the complementary attachment mechanisms 26, 27 and 36, 37 can be any of a variety of attachment mechanisms which allow for removable attachment of the baseball catching training device 10. The baseball catching training device 10 further includes a connecting strap 50. The connecting strap 50 is preferably constructed from an elongated, flexible and stretchable material. As was the case for the yokes, it can also be constructed from a wide range of available materials. The material should have an elasticity of at least 25% additional stretch length over its unstretched length. In the preferred embodiment, the length of the connecting strap 50 is no greater than 18 inches. In an alternate embodiment, the length of the connecting strap 50 is no greater than 14 inches. The connecting strap 50 has a pair of ends 51, 52 which are connected to the middle sections 23 and 33 of the yokes 20 and 30, respectively. As illustrated below, this keeps both arms in sequence and synchronized when catching a baseball.

Figure 3:
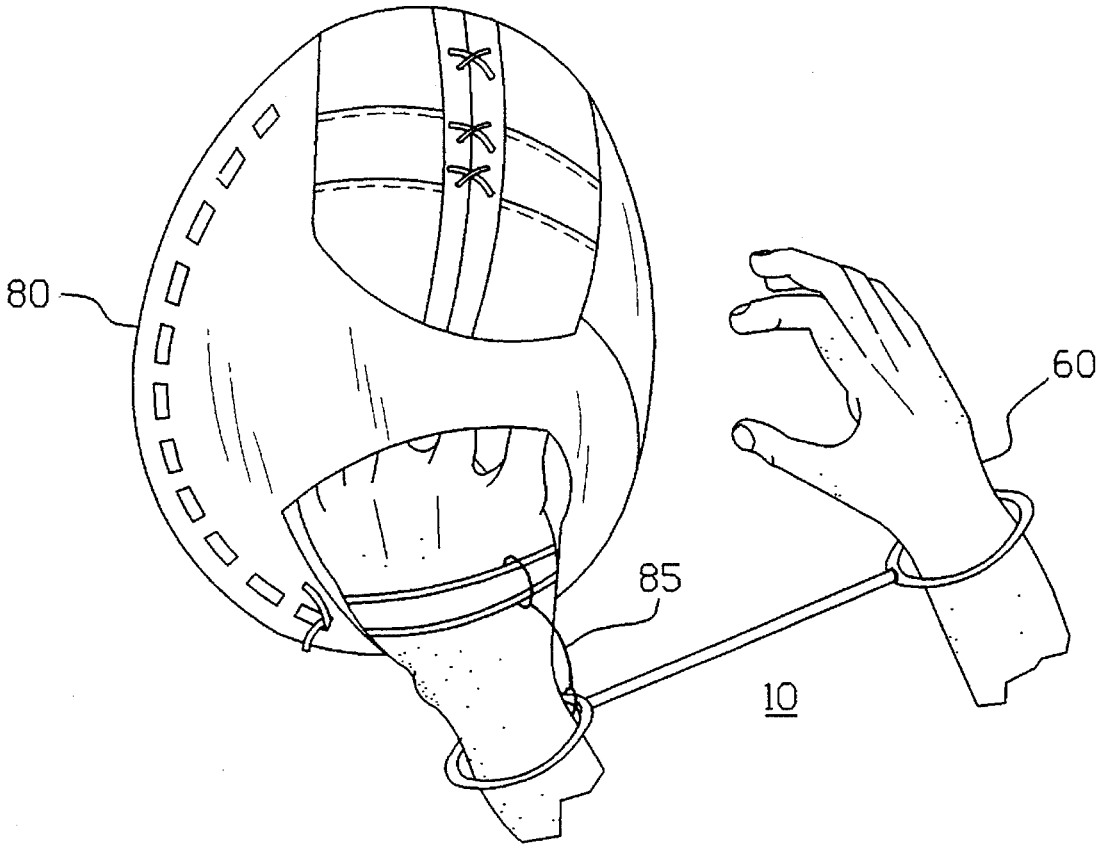

Referring to FIG. 3, in a further embodiment of the present invention, the baseball catching training device 10 can be attached to a glove 80 by using a glove attachment mechanism 85. The glove attachment mechanism 85 can be any of a variety of connection mechanisms which allows for attachment and removal of the baseball catching training device 10 from the glove 80.

Referring now to FIGS. 2 and 3, the user of the baseball catching training device 10 attaches the yokes 20 and 30 to wrists 60. The complementary attachment mechanisms 26, 27 and 36, 37 are mated together around wrists 60 and the connecting strap 50 is attached to the middle sections 23 and 33 of yokes 20 and 30. In addition, the glove attachment mechanism 85 can be attached to the glove 80 if so desired. Once the attachments are made, the wrists 60 will then move in concert when attempting to catch a baseball. In other words, once the user attempts to catch the baseball with the baseball catching training device 10, the arm not having the glove 80 will be automatically raised in synchronization with the gloved hand. By using the baseball catching training device 10, the user will develop the tendency to raise both arms when attempting to catch the baseball. By forcing both hands to be involved during the catching of the baseball, the user will make less errors and quicker throws.

Obviously, numerous modifications and variations of the present invention are possible in light of the above teachings. It is therefore understood that within the scope of the appended claims, the invention may be practiced otherwise than as specifically described herein.

What is claimed is:

1. A baseball catching training device, which comprises:

a) A first yoke for removable attachment to a first wrist of a user and a second yoke for removable attachment to a second wrist of said user, said first yoke and said second yoke being made of flexible material, being elongated and having a middle portion and each having two opposing ends, said opposing ends having complementary attachment mechanisms for removably attaching one opposing end to an opposite opposing end;

b) a connecting strap having a first end and a second end, said first end being connected to the middle portion of said first yoke and said second end being connected to the middle portion of said second yoke, said connecting strap being flexible and stretchable and being elongated and having a length no greater than 18 inches; and, c) a glove attachment means for removable attachment to a baseball glove.

2. The device of claim 1 wherein said connecting strap has a length no greater than 14 inches.

3. The device of claim 1 wherein said complementary attachment mechanisms are looped and hooked filament attachment mechanisms.

4. The device of claim 1 wherein said connecting strap has a length no greater than 14 inches.

5. The device of claim 1 wherein said complementary attachment mechanisms are looped and hooked filament attachment mechanisms.

6. The device of claim 5 wherein said connecting strap has an elasticity of at least 25% additional stretch length over its unstretched length.

7. The device of claim 6 wherein said yokes are inflexible.

8. The device of claim 1 wherein said yokes are inflexible.

9. The device of claim 1 wherein said connecting strap has an elasticity of at least 25% additional stretch length over its unstretched length.

10. A method of training a baseball player to catch balls with two hands, which comprises:

1) attaching a baseball glove to one hand of said baseball player and attaching to said baseball player's wrists, a baseball catching training device, which includes a) a first yoke for removable attachment to a first wrist of said player and a second yoke for removable attachment to a second wrist of said player, said first yoke and said second yoke being made of flexible material, being elongated and having a middle portion and each having two opposing ends, said opposing ends having complementary attachment mechanisms for removably attaching one opposing end to an opposite opposing end; and, b) a connecting strap having a first end and a second end, said first end being connected to the middle portion of said first yoke and said second end being connected to the middle portion of said second yoke, said connecting strap being flexible and stretchable and being elongated and having a length no greater than 18 inches; and, 2) projecting a ball toward said player for catching such that when said player raises said glove to catch, the ungloved hand is automatically pulled up by said device to encourage a two handed catch.

11. The method of claim 10 wherein said connecting strap has a length no greater than 14 inches.

12. The method of claim 10 wherein said complementary attachment mechanisms are looped and hooked filament attachment mechanisms.

13. The method of claim 10 which additionally includes glove attachment means for removable attachment to a baseball glove.

14. The method of claim 13 wherein said connecting strap has a length no greater than 14 inches.

15. The method of claim 13 wherein said complementary attachment mechanisms are looped and hooked filament attachment mechanisms.

16. The method of claim 15 wherein said connecting strap has an elasticity of at least 25% additional stretch length over its unstretched length.

17. The method of claim 16 wherein said yokes are inflexible.

18. The method of claim 10 wherein said yokes are inflexible.

19. The method of claim 10 wherein said connecting strap has an elasticity of at least 25% additional stretch length over its unstretched length.

* * * * *